US008452032B2

(12) United States Patent
Varla et al.

(10) Patent No.: US 8,452,032 B2
(45) Date of Patent: May 28, 2013

(54) NESTED COMPOUND LOUDSPEAKER DRIVE UNIT

(75) Inventors: Ari Varla, Iisalmi (FI); Ilpo Martikainen, Mäntylahti (FI); Anni Tuulia Kolisoja, legal representative, Helsinki (FI); Terhi Ina Aurora Varla, legal representative, Iisalmi (FI); Arno Mikael Varla, legal representative, Iisalmi (FI)

(73) Assignee: Genelec Oy, Iisalmi (FI)

( * ) Notice: Subject to any disclaimer, the term of this patent is extended or adjusted under 35 U.S.C. 154(b) by 104 days.

(21) Appl. No.: 13/055,271

(22) PCT Filed: Jul. 24, 2008

(86) PCT No.: PCT/FI2008/050444

§ 371 (c)(1),
(2), (4) Date: Mar. 14, 2011

(87) PCT Pub. No.: WO2010/010225

PCT Pub. Date: Jan. 28, 2010

(65) Prior Publication Data

US 2011/0228966 A1 Sep. 22, 2011

(51) Int. Cl.
*H04R 25/00* (2006.01)

(52) U.S. Cl.
USPC ..... 381/182; 381/186

(58) Field of Classification Search
USPC ..... 381/182, 184, 185, 186, 386, 396, 381/401, 402; 181/141, 144, 154, 163, 199
See application file for complete search history.

(56) References Cited

U.S. PATENT DOCUMENTS

| | | | |
|---|---|---|---|
| 4,554,414 | A | 11/1985 | House |
| 4,837,839 | A | 6/1989 | Andrews |
| 5,548,657 | A | 8/1996 | Fincham |
| 5,629,501 | A | 5/1997 | Fenton |
| 6,745,867 | B2 | 6/2004 | Anthony et al. |

FOREIGN PATENT DOCUMENTS

| | | | |
|---|---|---|---|
| JP | 55-046673 | A | 4/1980 |
| JP | 60-091798 | A | 5/1985 |
| JP | 61-121687 | A | 6/1986 |
| JP | 2004-48432 | A | 2/2004 |
| JP | 2006-303778 | A | 11/2006 |

*Primary Examiner* — Tuan D Nguyen
(74) *Attorney, Agent, or Firm* — Birch, Stewart, Kolasch & Birch, LLP

(57) ABSTRACT

A nested compound loudspeaker comprising a speaker assembly chassis (11), an outer driver (18) connected to the speaker assembly chassis (11) and having an inner edge, which defines an opening in the outer driver (18) and forms a functional edge (20), and an inner driver (8) connected to the speaker assembly chassis (11) and at least partially surrounded by the opening of the outer driver (18) and the inner driver (8) having an acoustical center axis located at a distance (r) from the functional edge (20) in a radial direction (α). The distance (r) is non-constant around the acoustical center axis, wherein the distance (r) has a first value in a first radial direction (α) and a second value different to the first value in a second radial direction (α).

29 Claims, 13 Drawing Sheets

NESTED COMPOUND LOUDSPEAKER DRIVE UNIT

FIELD OF THE INVENTION

The present invention relates to loudspeakers. In particular the present invention relates to compound loudspeaker drive units wherein separate diaphragms are provided for reproduction of low and high frequencies.

PRIOR ART

Compound loudspeakers conventionally comprise at least two drive units, which provide reproduction of suitable bands of low and high frequencies. Traditionally the low and the high frequency drive units have been separate entities, but when pursuing high fidelity without response and directivity irregularities, the drive units are positioned somewhat concentrically. Thus, improved compound loudspeaker drive units are typically low/mid frequency units integrated with a high frequency drive unit wherein each of the high frequency units are separately attached either in front of or close to the low frequency voice coil of the system. An example of the latter may be found in publication U.S. Pat. No. 5,548,657, which discloses a high frequency driver that has been nested inside a low frequency voice coil and separated from the coil by a sufficient gap to allow contact-free axial motion of the said voice coil.

DISADVANTAGES OF THE PRIOR ART

The prior art designs typically suffer from acoustical mismatch between the high frequency diaphragm and its close bounding acoustical surfaces, primarily the low frequency cone including its surroundings. If the high frequency diaphragm is elevated forward from the low frequency cone neck, a part of the radiation of the high frequency diaphragm is directed rearwards towards the low frequency cone and is further reflected back forward from the cone with the result of interfering with the direct radiation from the high frequency diaphragm. This will degrade the high frequency radiation characteristics of the high frequency diaphragm by causing a comb-filter effect into the acoustic frequency response of the system. Referring to the application disclosed in publication U.S. Pat. No. 5,548,657, another type of acoustical mismatch occurs in between the cone and the high frequency diaphragm where a circular gap has been left between the cone and the high frequency driver annular baffle to allow axial movement of the low frequency cone.

This gap forms an acoustical coupling mismatch for the high frequency diaphragm and due to its circular shape and the radial nature of the radiated wave front of the said diaphragm, a significant diffraction typically occurs on the frontal radiation axis of the system. The frequency range of such diffraction is typically between 2 kHz and 20 kHz, depending upon the used driver geometry. The same phenomenon causes also the outer flexible surround to generate an acoustical mismatch resulting in radial diffraction in the same manner as the voice coil neck, but at different frequencies. An attempt has been made in publication U.S. Pat. No. 6,745,867 to avoid this problem by smoothening the surround geometry.

OBJECT OF THE INVENTION

It is an object of the present invention to provide an improved nested compound loudspeaker, which will overcome at least some of the above-mentioned disadvantages.

Therefore a new type of a compound driver construction principle is presented, which driver provides for a principle of reducing the impairing effect of a radially regular discontinuity on the front face of the loudspeaker.

SUMMARY OF THE INVENTION

The invention is based on a new type of loudspeaker driver comprising a speaker assembly chassis, an outer driver connected thereto and the outer driver having an inner edge, which defines an opening in the outer driver and forms a functional edge. To the speaker assembly chassis is further connected an inner driver, which is at least partially surrounded by the opening of the outer driver, and which has an acoustical centre axis located at a distance from the functional edge in a radial direction. The distance is non-constant around the acoustical centre axis, wherein the distance has a first value in a first radial direction and a second value different to the first value in a second radial direction, excluding non-constant offsets caused by manufacturing tolerances.

More specifically, the apparatus according to the invention is characterized by what is stated in the characterizing portion of the independent claim 1.

ADVANTAGES

Considerable advantages are gained with the aid of the invention. Due to the radially irregular discontinuity of the forward face of the driver, the sound fronts emanated by the inner driver are not diffracted simultaneously thus mitigating the experienced frequency response impairment. Therefore due to the acoustically diffraction-reduced operating environment of the inner drive unit, both on- and off-axis frequency responses remain smooth and neutral. It is a further advantage that the diffraction is reduced in all extents of axial excursions of the outer driver.

In the following certain embodiments according to the invention are discussed with reference to the accompanied drawings, in which:

DESCRIPTION OF THE PREFERRED EMBODIMENTS

In the following certain essential terms are defined. In this context the term voice coil former is used to refer to any sort of structure capable of mechanically connecting a voice coil and a vibrating diaphragm.

In this context the term forward means the direction to which sound waves primarily radiate from the speaker, i.e. the direction to which the diaphragm movement approaches the assumed sound receiver. Conversely, the term rearward means the opposite of forward direction. Respectively, the terms front and rear represent the sides of the speaker that are in the direction of forward or rearward directions. Furthermore, the term axial direction means the direction to which the diaphragms are adapted to move. Respectively the term radial direction means all directions normal to the axial direction in question. In addition it is assumed that the loudspeaker and the assumed sound receiver share vertical and horizontal axes, i.e. so called up and down directions.

Finally, in this context approximately n degrees means that the angle is at short range from, but not exactly, n degrees excluding conventional manufacturing tolerances. Also by functional edge of the outer driver is meant the inner edge of the low frequency driver adapter when such an element is applied, but alternatively it means the inner edge of the outer diaphragm in applications that do not include a low frequency driver adapter.

Figure 1:
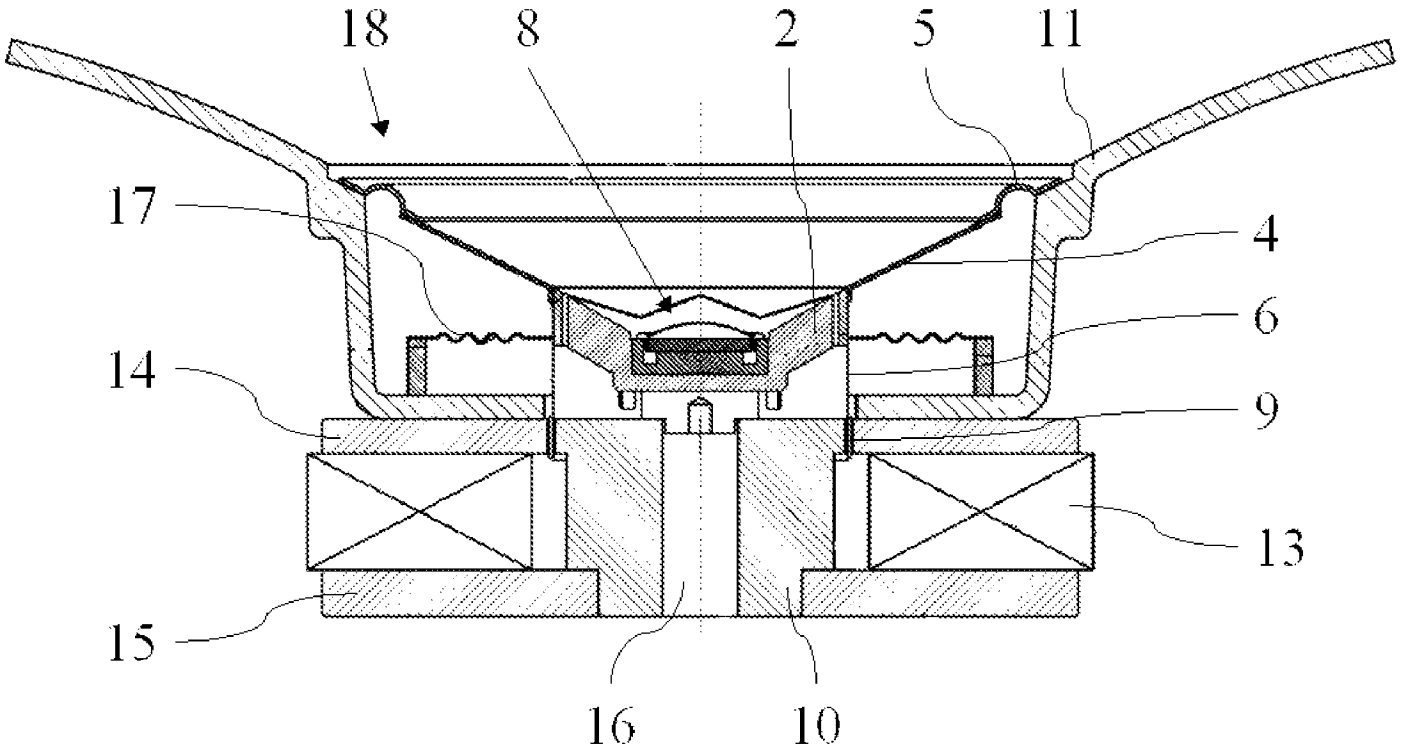
FIG. 1 shows a cross section-view of a first embodiment according to the invention.

As illustrated in FIG. 1*a* nested compound loudspeaker according to the present invention has a speaker assembly chassis 11 which accommodates the functional parts of the loudspeaker and which is to be connected to the loudspeaker enclosure (not shown). In short, the assembly chassis 11 and its auxiliary structural elements accommodate a high frequency driver 8 nested within a low frequency driver 18 so that the diaphragm 7 of the high frequency driver 8 is located rearward of the outer edge of the diaphragm 4 of the low frequency driver 18.

The speaker assembly chassis 11 houses auxiliary structural elements that provide a rigid body for a plurality of functional elements providing the desired sound reproduction. These structural elements include a magnetic circuit yoke plate 14, which is attached to the rear flange of the speaker assembly chassis 11. The magnetic circuit yoke plate 14 has an opening in the middle into which opening has been fitted a pole piece 10, which has a hole 16 in the middle extending through the whole piece. In the rear end of the pole piece 10 there is a shoulder onto which is fitted a magnetic circuit back plate 15. The magnetic circuit back plate 15 and yoke plate 14 together with the bored pole piece 10 provide the necessary magnetic circuit structure for a magnetic field created by permanent magnet 13 fitted between the magnetic circuit yoke plate 14 and back plate 15.

Figure 2:
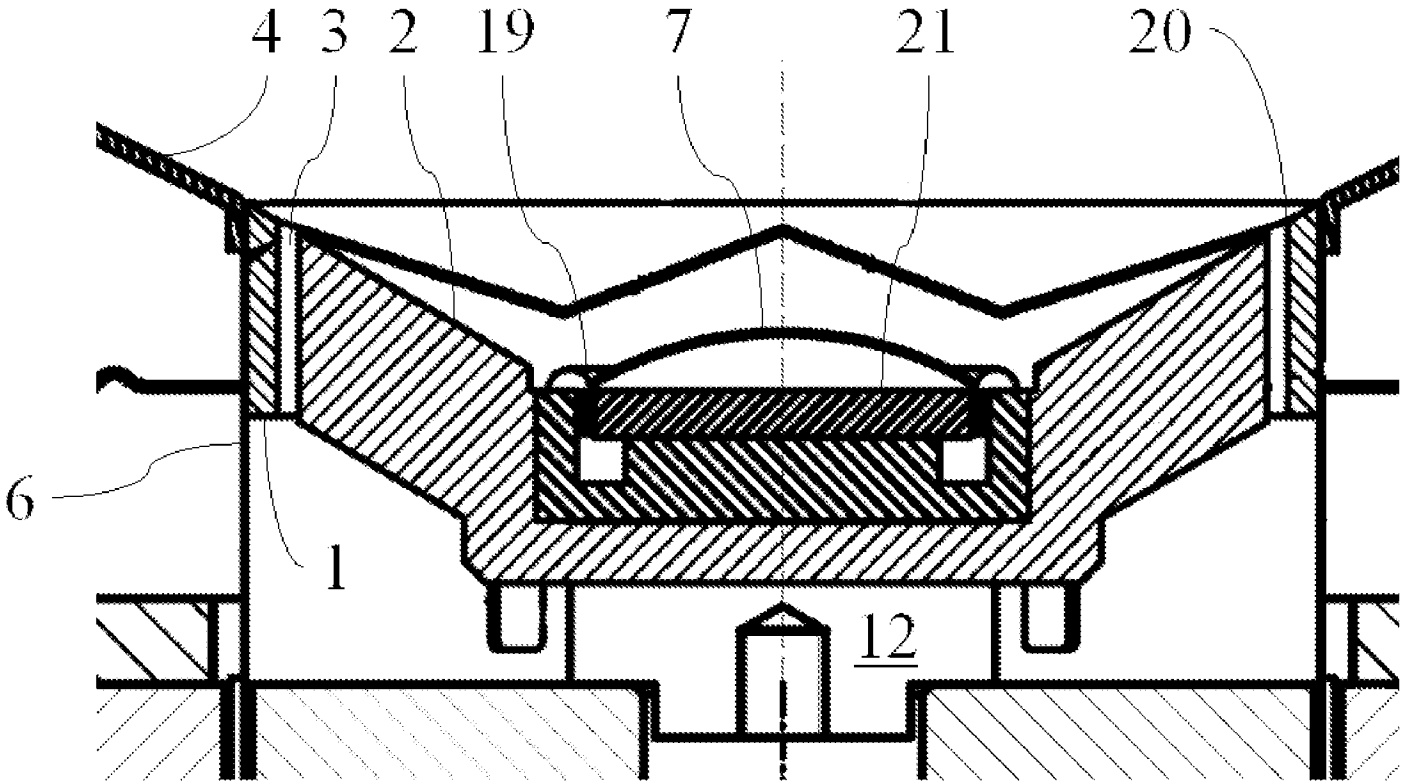
FIG. 2 shows a detail view of FIG. 1.

As is illustrated in FIG. 2, the auxiliary structural elements further include a high frequency driver mounting adapter 12 attached from its rear end onto the front end of the pole piece 10. The high frequency driver mounting adapter 12 is attached from its front end to a high frequency adapter 2, which accommodates the high frequency driver 8. The high frequency driver 8 comprises a high frequency driver diaphragm 7 to whose outer edge is attached to a second voice coil winding to interact with a second permanent magnet 21 also nested within the high frequency adapter 2.

The functional elements of the loudspeaker include a low frequency driver 18 and a high frequency driver 8 as well as the permanent magnet 13. The low frequency driver 18 comprises a diaphragm 4, which is attached to the speaker assembly chassis 11 from its outer seam through an elastomer outer suspension 5. The suspension 5 is made of elastic lossy material, such as rubber of plastic. The suspension 5 is advantageously made as flat as possible to avoid unnecessary elevations or discontinuities causing diffraction and thus impairing the frequency response of the loudspeaker. Generally speaking the profile of the outer suspension is generated smaller the less excursion length is required from the outer diaphragm 4. In addition, the dissipation factor is preferably selected so that flexural wave proceeding on the diaphragm 4 is terminated into the suspension 5.

In the inner edge of the diaphragm 4 there is, according to the first embodiment of the invention, a low frequency driver adapter 1, which is further connected to a voice coil former 6. There is a clearance 3 between the low 1 and high frequency driver adapter 2 allowing the low frequency driver adapter 1 to experience sound producing excursions along with the voice coil winding 9 relative to the high frequency driver adapter 2. In a broader sense the clearance 3 stands for the gap left between the high frequency driver adapter 2 and the element surrounding it, i.e. the element may also be the inner edge of the diaphragm 4 in applications that do not require a low frequency driver adapter 1.

The forward surface of the high 2 and low frequency driver adapters 1 as well as the diaphragm 4 are tangent so that the sound emanated from the high frequency driver 8 is able to travel without being refracted by hindrances on said surfaces. Because the low frequency driver adapter 1 is adapted to share movement with the voice coil winding 9, former 6 and the diaphragm 4, it is advantageously manufactured of solid lightweight material, such as plastic, aluminium or magnesium, in order to minimise added moving mass of the voice coil 6. This has an improving effect to the responsiveness of the driver. The voice coil former 6 connects the low frequency driver adapter 1 to the voice coil winding 9, which is located in a gap between the magnetic circuit yoke plate 14 and the pole piece 10. The aforementioned gap between the magnetic circuit yoke plate 14 and the pole piece 10 provides a clear headway for the voice coil winding 9 to move forward and backward. Therefore, when alternating current is conducted to the voice coil winding 9, the induced magnetic field together with the prevailing magnetic field created by the permanent magnet 13 cause the voice coil winding 9 to deviate forward and backward. The movement is delivered via the voice coil former 6 to the diaphragm 4, which is adapted to change position axially. The movement may be delivered to the diaphragm 4 either directly or through the low frequency driver adapter 1. A similar phenomenon occurs in the high frequency driver 18, in which its driving means 19, comprising a permanent magnet and a voice coil winding, delivers axial to-and-fro movement to the diaphragm 7.

The voice coil former 6 is supported and centred by a voice coil flexible suspension 17, which is often referred to as a spider. The voice coil flexible suspension 17 is attached to the side of the voice coil former 6 from one end and to a support bar from the other. The support bar is fixed to the forward side of the rear flange of the speaker assembly chassis 11. The voice coil flexible suspension 17 consists of two coaxial rings connected by a sheet having annular corrugations. It supports the voice coil winding 9, the voice coil former 6 and the diaphragm 4 so that the mechanism remains concentric with the poles of the magnetic circuit 10, 13, 14, 15 and so that the voice coil winding 9 does not become into contact with the parts 14, 10 surrounding the gap in which it is able to move.

Because the diaphragm 4 is well supported by the voice coil flexible suspension 17, it can be subjected to great axial excursions and thus considerably low frequencies. Since the low frequency driver can reproduce low frequencies, the crossover point may be as low as 800 Hz to 5 kHz. In this respect all frequencies below the crossover point shall hereon be considered low and frequencies above it shall be considered high.

Figure 3:
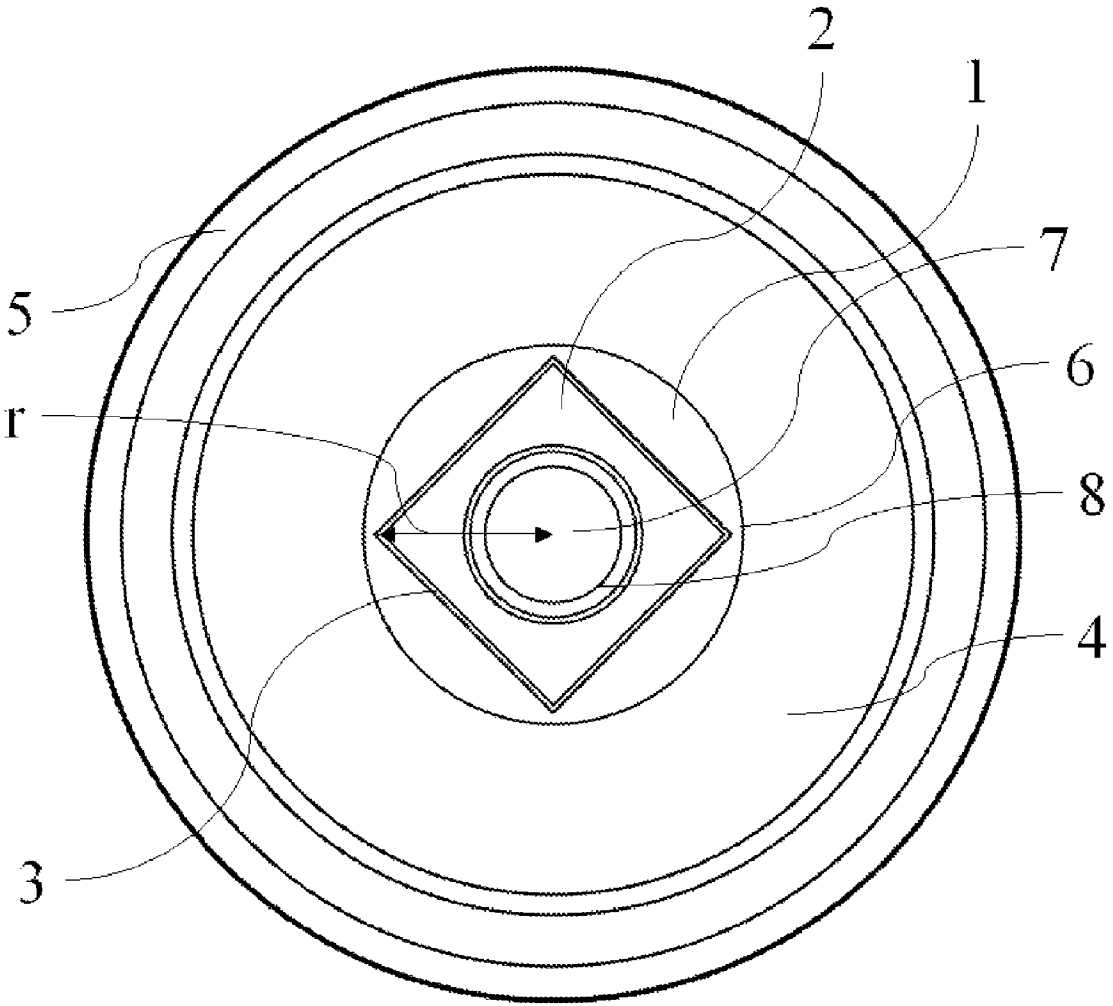
FIG. 3 shows a frontal view of the same embodiment.

As illustrated in FIG. 3, according to the first embodiment of the present invention, the low 1 and high frequency driver adapters 2 are arranged so that the clearance 3 between the adapters is not circular but polygonal. As the low frequency driver adapter 1, and indeed the diaphragm 4, is made to move relative to the high frequency driver adapter 2, the elevated and descended low frequency driver adapter 1 inflicts a discontinuity on the front surface of the compound driver. If the clearance 3 were to be of a circular shape, the sound fronts produced by the high frequency driver 8 to each radial direction would all reach the discontinuity simultaneously. This would cause significant accentuation in the frequency response of the loudspeaker thus impairing its ability to reproduce sound as neutrally as possible.

To overcome the disadvantage of the discontinuity being at a constant radial distance r from the acoustic centre of the high frequency driver 8, the outer edge 20 of the clearance 3 is made to surround the driver 8 at variable distances r thus being polygonal in shape, for example. The polygon illustrated in FIG. 3 has eight angles so that every other angle is approximately 180 degrees and every other angle is approximately 90 degrees. To be precise, every other angle is more than 180 degrees and every other angle is less than 90 degrees.

Figure 9:
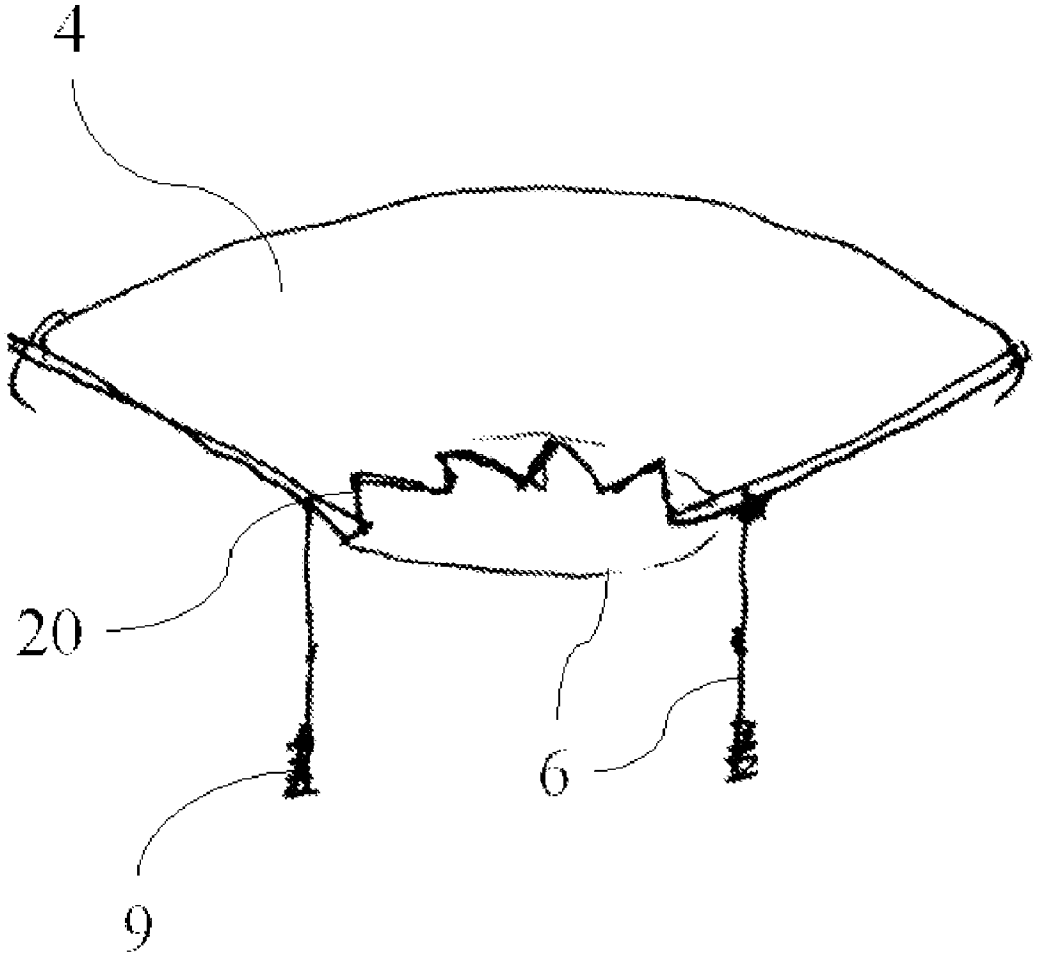
FIG. 9 shows a star-like shaped inner edge of the outer diaphragm with a circular voice coil former attached to its rear face.
Figure 10:
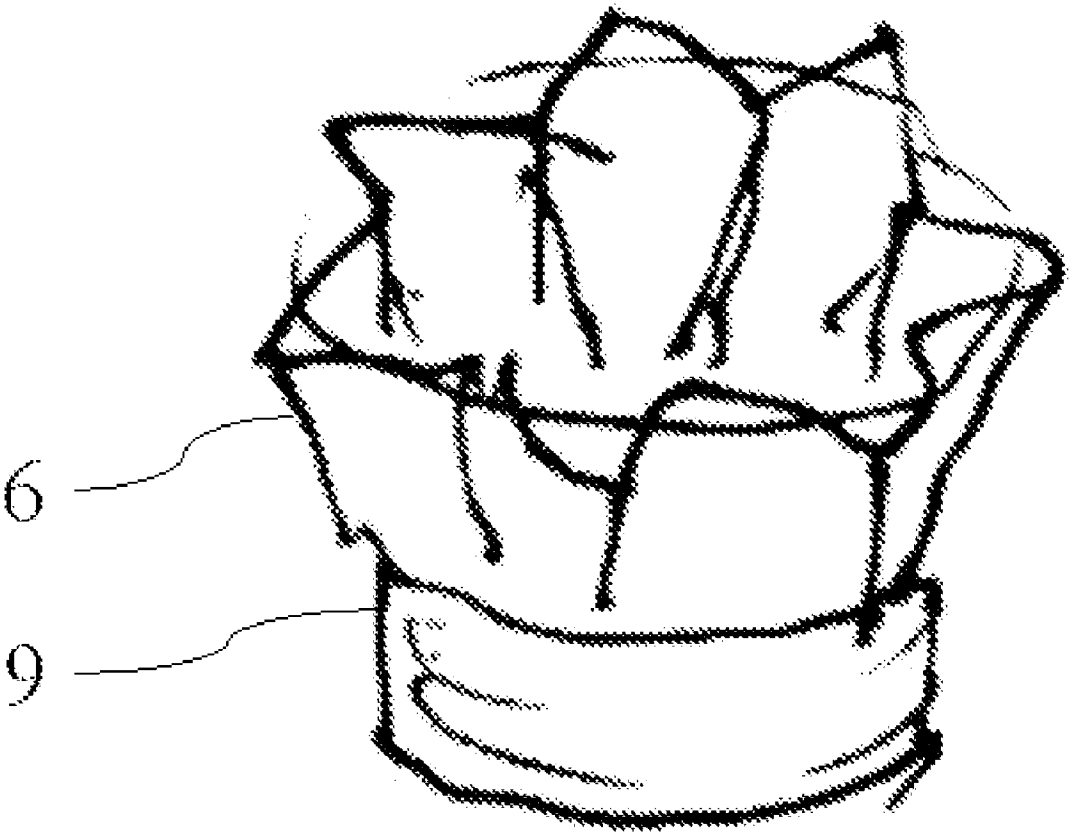
FIG. 10 shows a voice coil former having a star-shaped cross-section at the front edge and a circular cross-section at the rear.
Figure 11:
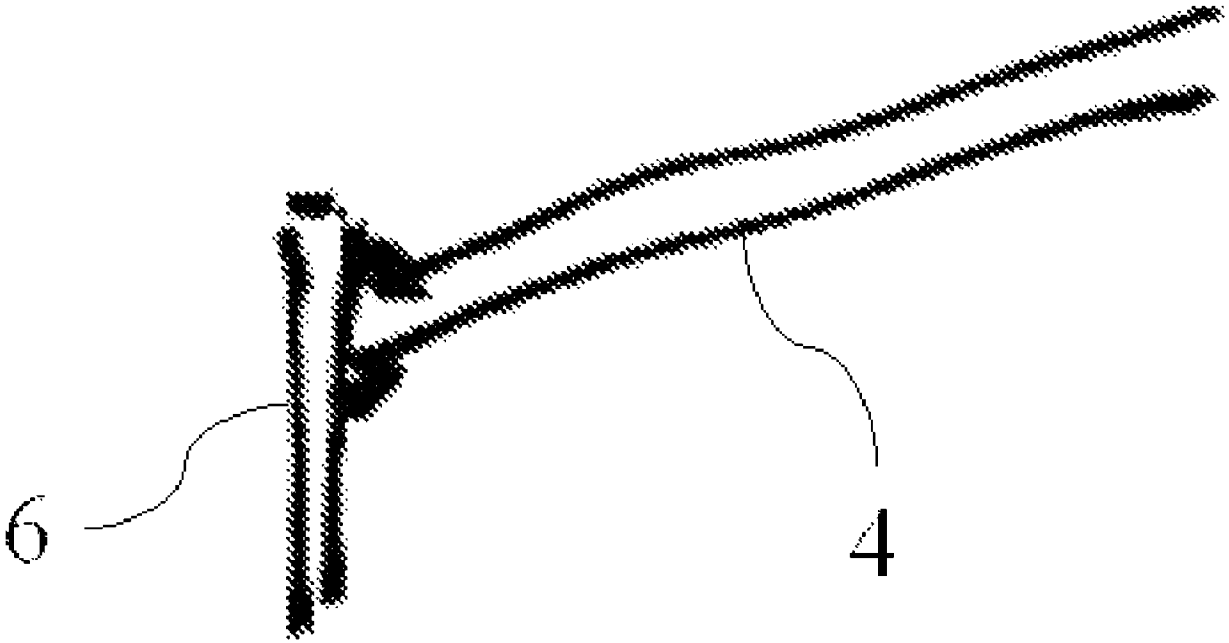
FIG. 11 shows a voice coil former attached from its side edge to the inner edge of the outer diaphragm.
Figure 12:
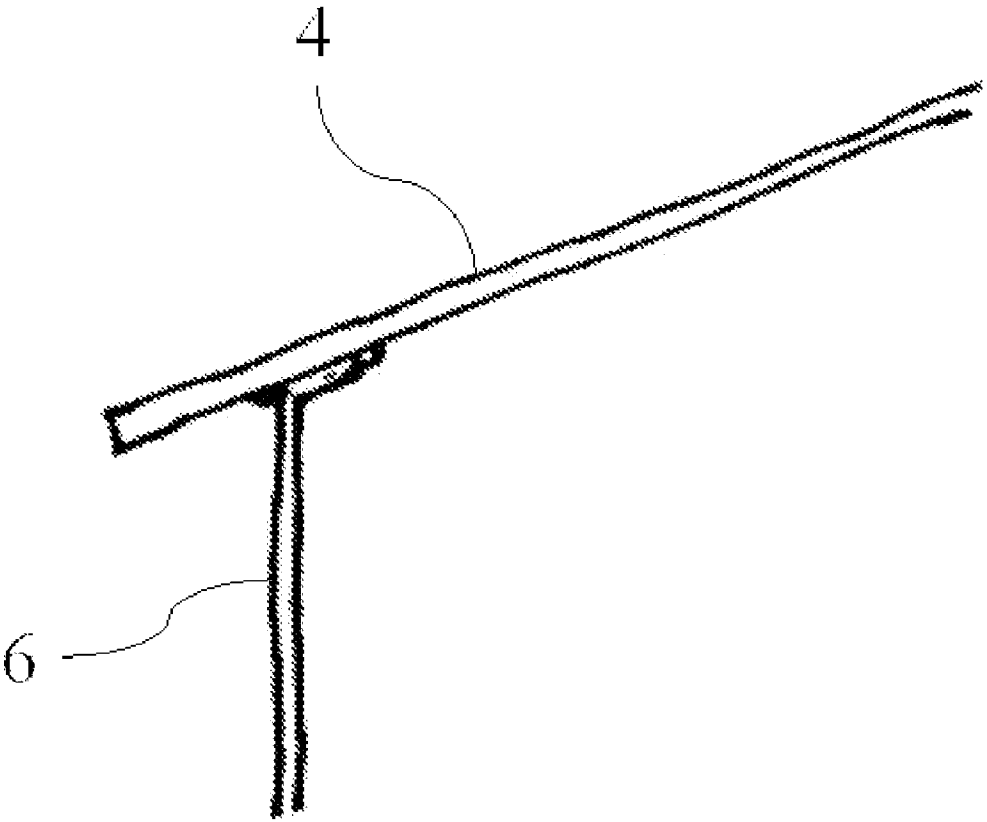
FIG. 12 shows a voice coil former attached from its front edge to the rear face of the outer diaphragm.
Figure 13:
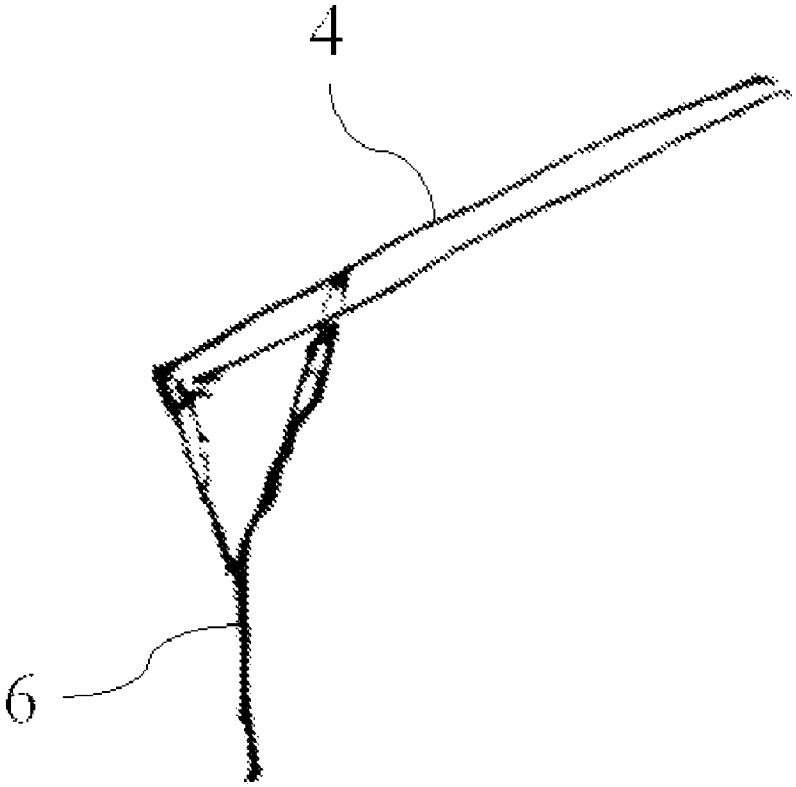
FIG. 13 shows a star-like shaped voice coil former attached to the outer diaphragm.

The polygon may also have a different shape. It may be quadrangular, triangular, or even of a star-like shape, as illustrated in FIG. 9. In any case it is essential that as few sound fronts arrive simultaneously to the discontinuity as possible. Whatever the shape is, the low and high frequency driver adapters 1, 2 must have a corresponding shape, which means that the voice coil former 6 may also have to conform to the shape at its front end. If, for example, the shape were to be star-like, the voice coil former 6 would be of star-like shape at the front end and of circular shape at the rear end, as illustrated in FIG. 10. This way the star-shaped voice coil former 6 would be attached to the inner edge of the star-shaped low frequency driver adapter 1. Alternatively as illustrated in FIGS. 9 and 12, the voice coil former 6 can be constantly circular, wherein it would be attached to the rear face of the low frequency diaphragm 4 or driver adapter 1, which would be of a star-like shape. All in all, different arrangements for attaching the voice coil former 6 to the outer diaphragm 4 are presented in FIGS. 11 to 13.

Figure 4:
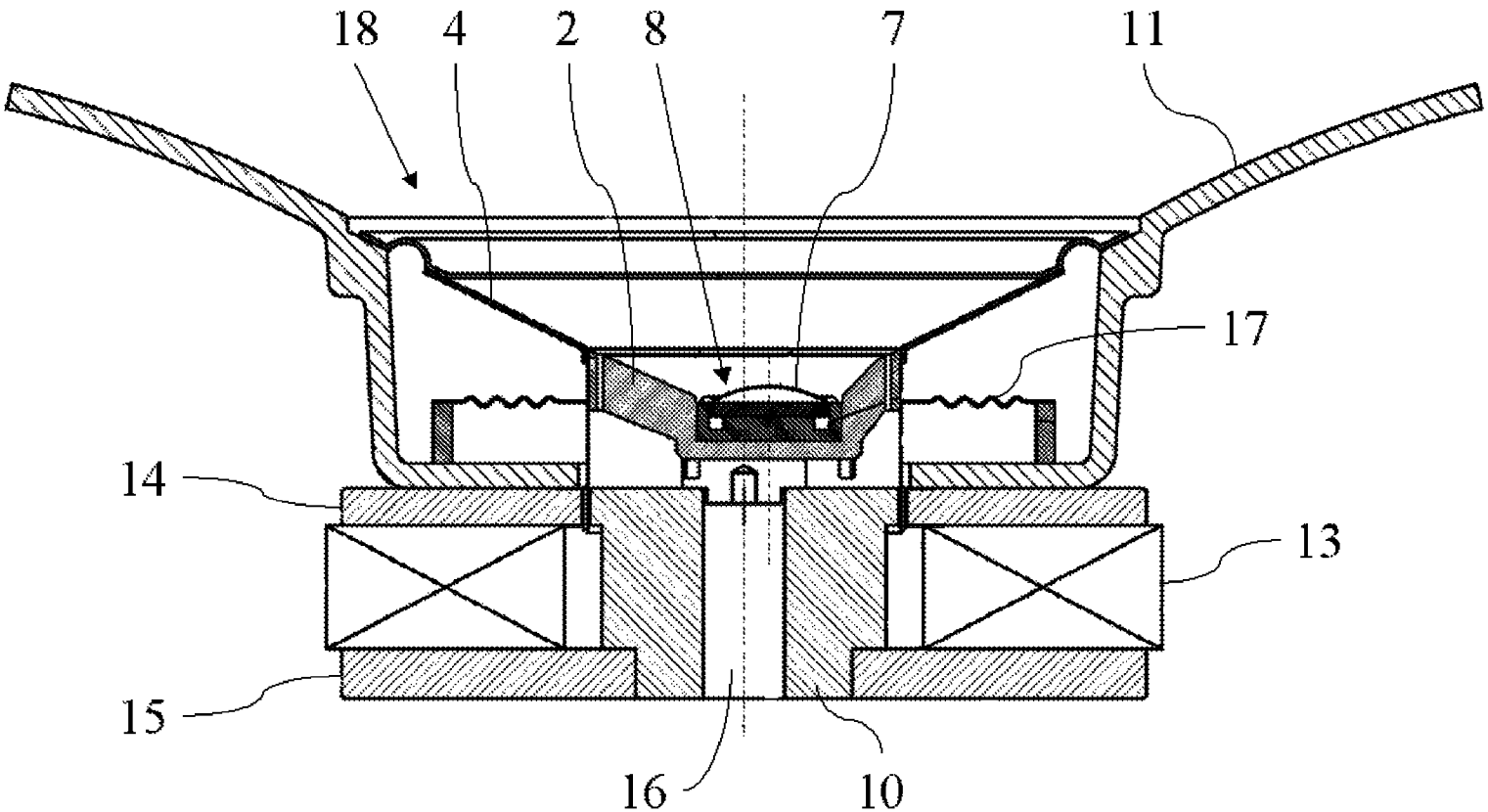
FIG. 4 shows a vertical cross-section view of another embodiment according to the invention.
Figure 5:
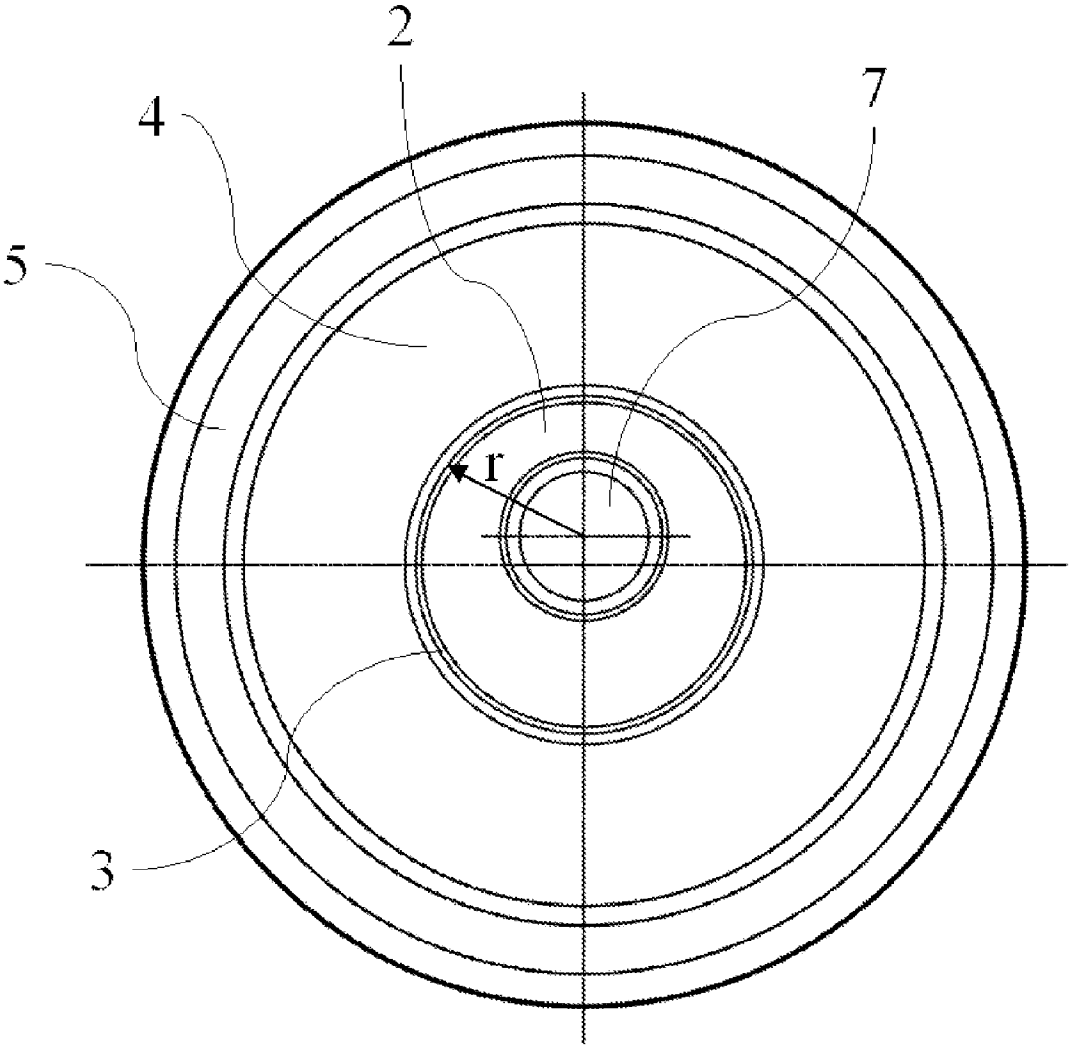
FIG. 5 shows a frontal view of the second embodiment.
Figure 6:
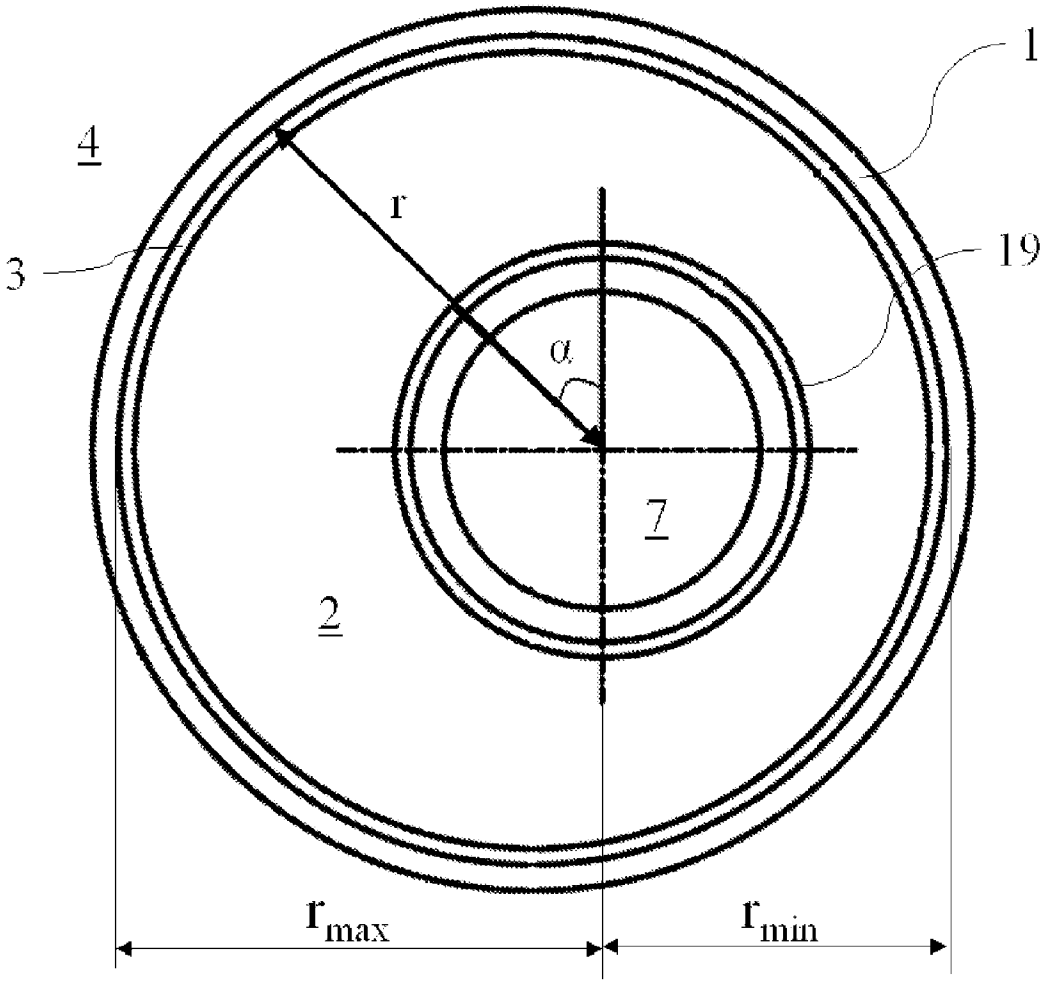
FIG. 6 shows a frontal detail view of the vertical offset of the inner driver according to the second embodiment.

As illustrated in FIGS. 4 to 6, according to the second embodiment of the present invention, the principle—of having the discontinuity of the forward face of the loudspeaker at various distances r from the acoustic centre of the high frequency driver 8 in various radial directions α—can also be executed by arranging the two drivers 8,18 eccentrically. The non-symmetry appears advantageously along the vertical axis where it has less audible effects than it would have being along the horizontal axis. This way there is symmetrical horizontal acoustic dispersion while vertically eccentric sound sources cause only marginal distortion due to the rather minor offset.

Compared to the first embodiment, the second embodiment introduces an asymmetric high frequency driver adapter 2 that is offset slightly along the vertical axis. It could also be offset slightly along the horizontal axis as well, but that would not result in a similarly outstanding outcome due to reasons stated above. Since the high frequency driver adapter 2 does not share its central axis with the rest of the structure, e.g. pole piece hole 16, the front surface of the adapter 2 is not tangential with the surrounding diaphragm 4 in every direction α as would be the case according to the first embodiment. However, said surfaces are tangential in at least one direction α, which is directly downward in the vertical direction in this particular example. Another difference is that there is no immediate requirement for a low frequency driver adapter 1. This is because the high frequency driver adapter 2 does not have a polygonal shape to which the adjacent diaphragm 4 would have to adapt. Therefore the adapter 2 may be of circular shape at the outer perimeter thus making it unnecessary to equip the inner edge of the low frequency diaphragm 4 with a low frequency driver adapter 1. In such a case, the voice coil former 6 would be connected directly to the rear face or inner edge of the diaphragm 4.

Figure 7:
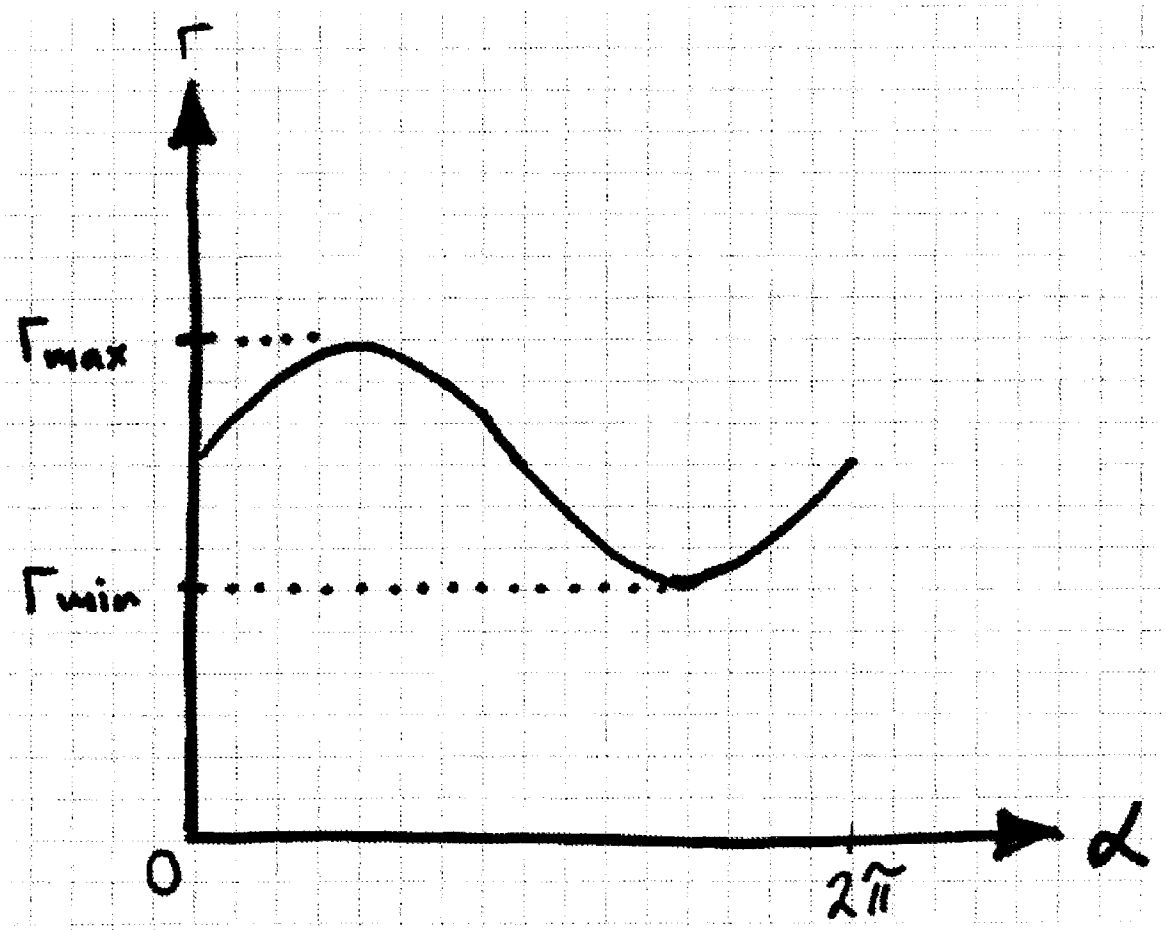
FIGS. 7 and 8 show a plot illustrating how the distance between the central axis of the inner driver and the functional inner edge of the outer driver varies in different radial directions according to the former and latter embodiments of the present invention, respectively.
Figure 8:
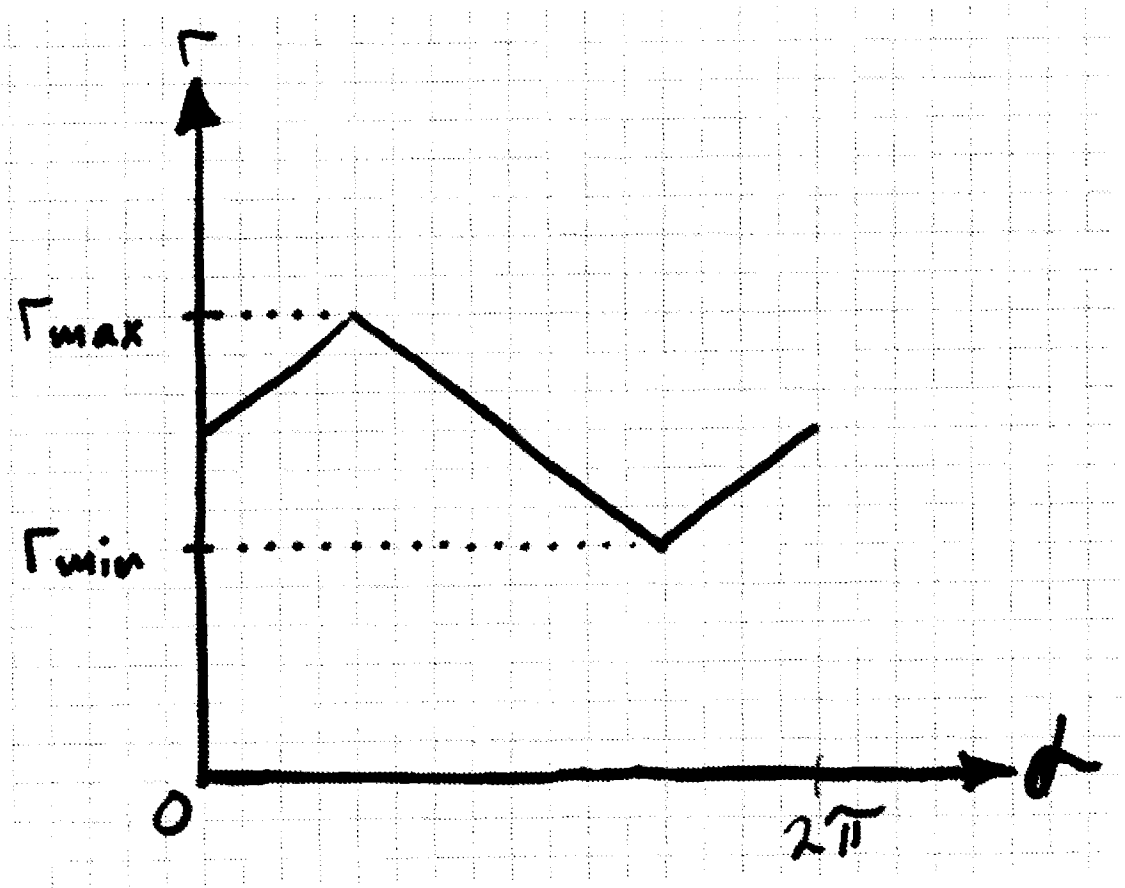

As illustrated in FIGS. 7 and 8, it is essential that the distance r between the acoustic central axis of the high frequency driver 8 and the discontinuity 20, caused by the axial excursions made by the innermost edge of the low frequency driver 18, is variable in different radial directions α. As is apparent from FIG. 7, the vertical offset of the high frequency driver 8 causes the α,r curve to fluctuate so that the curve is not horizontal, i.e. the distance r varies constantly as a function of the radial direction α of the high frequency driver 8. The curves illustrated in FIGS. 7 and 8 may therefore be seen as functions with the distance r being a function of the radial direction α of the high frequency driver 8. The α,r curve can comply with various different functions depending on the shape of the functional edge of the low frequency driver. The function may be continuous or discontinuous, periodic with one or more periods, aperiodic or even random.

As is therefore apparent from FIG. 8, the polygonal shape of the clearance 3 provides a similar effect although being a saw-tooth curve. However, there are of course points at equal distances r from the centre of the high frequency driver 8, but this way significantly fewer sound fronts reach the discontinuity simultaneously as would in the conventional applications.

As said, the variability of the distance r in different radial directions α is pivotal. The difference between the shortest ($r_{min}$) and longest ($r_{max}$) distance r is typically 5 to 20%, advantageously 10 to 15%. The range may also be even greater, but the best results are gained with about 15% of variance. In any case the variance is of different order of magnitude compared to conventional manufacturing tolerances, which are typically in the range of 0.5 to 1 mm or about 1 to 2%. It is to be noted that in order to accomplish the desired effect, the variation of the distance r is made perceptibly intentionally, i.e. the natural variance due to manufacturing tolerances is excluded for not sufficiently mitigating the accentuation caused by a discontinuity at a constant distance from the inner sound source. Furthermore, it is possible—within the scope of the present invention—to combine different features disclosed herein to create a compound loudspeaker that has a radially irregular discontinuity. It would be possible, for example, to build a compound loudspeaker with a star-like shaped clearance 3 and with a vertically offset high frequency driver 8. Further combinations are too considered feasible to a man skilled in the art.

List of index numbers

| Index number | Element |
|---|---|
| 1 | Low frequency driver adapter |
| 2 | High frequency driver adapter |
| 3 | Clearance (between the high frequency driver adapter 2 and the functional edge of the outer driver) |
| 4 | Diaphragm (of the outer driver) |
| 5 | Outer suspension of the outer driver |
| 6 | Voice coil former |
| 7 | Diaphragm (of the high frequency driver) |
| 8 | High frequency driver |
| 9 | Voice coil winding (of the outer driver) |
| 10 | Pole piece |
| 11 | Speaker assembly chassis |
| 12 | High frequency driver mounting adapter |
| 13 | Permanent magnet |
| 14 | Magnetic circuit yoke plate |
| 15 | Magnetic circuit back plate |
| 16 | Pole piece hole |
| 17 | Voice coil flexible suspension |
| 18 | Outer driver |
| 19 | Driving means of the high frequency driver 8 |
| r | Distance between the acoustical centre axis of the high frequency driver 8 and the functional outer edge of the outer diaphragm [mm] |
| 20 | Functional outer edge |
| 21 | Permanent magnet of the high frequency driver 8 |
| $r_{min}$ | The smallest distance r measured [mm] |
| $r_{max}$ | The largest distance r measured [mm] |
| $\alpha$ | Angle in which the distance r is measured [deg/$\pi$] |

The invention claimed is:

1. A nested compound loudspeaker comprising:

a speaker assembly chassis;

an outer driver connected to the speaker assembly chassis and having an inner edge, which defines an opening in the outer driver and forms a functional edge, and a diaphragm and an outer edge; and an inner driver connected to the speaker assembly chassis and at least partially surrounded by the opening of the outer driver and the inner driver having a diaphragm which is located rearward of the outer edge of the diaphragm of the outer driver and the inner driver also having an acoustical centre axis located at a distance from the functional edge in a radial direction, wherein the distance is non-constant around the acoustical centre axis, wherein the distance has a first value in a first radial direction and a second value different to the first value in a second radial direction.

2. A nested compound loudspeaker according to claim 1, wherein the loudspeaker further comprises at least one magnet for producing a magnetic field.

3. A nested compound loudspeaker according to claim 1, wherein each driver has a diaphragm.

4. A nested compound loudspeaker according to claim 3, wherein the drivers further comprise driving means for providing axial movement to the diaphragms of said drivers (18; 8) with the aid of the magnetic field.

5. A nested compound loudspeaker according to claim 1, wherein the inner driver has its own magnet for producing a magnetic field.

6. A nested compound loudspeaker according to claim 2, wherein the magnet is a permanent magnet.

7. A nested compound loudspeaker according to claim 1, wherein the diaphragm of the inner driver is mounted further back in its axial direction than the outer edge of the outer driver within which the inner driver is fitted.

8. A nested compound loudspeaker according to claim 1, wherein:

a low frequency driver adapter connected to the inner edge of the diaphragm of the outer driver, and in that the front surface of the low frequency driver adapter is tangent with the front surface of the diaphragm in at least one radial direction of the inner driver.

9. A nested compound loudspeaker according to claim 1, wherein the loudspeaker comprises a high frequency driver adapter configured to accommodate the inner driver, wherein the front surface of the high frequency driver adapter is tangent with the front surface of a stationary low frequency driver adapter of the outer driver in at least one radial direction of the inner driver.

10. A nested compound loudspeaker according to claim 1, wherein the distance is a function of the radial direction of the inner driver.

11. A nested compound loudspeaker according to claim 10, wherein the distance is a continuous function of the radial direction of the inner driver.

12. A nested compound loudspeaker according to claim 10, wherein the distance is a discontinuous function of the radial direction ($\alpha$) of the inner driver (8).

13. A nested compound loudspeaker according to claim 10, wherein the distance is a periodic function of the radial direction of the inner driver.

14. A nested compound loudspeaker according to claim 13, wherein the function is periodic with period 1.

15. A nested compound loudspeaker according to claim 13, wherein the function is periodic with period 2.

16. A nested compound loudspeaker according to claim 13, wherein the function is periodic with period 3.

17. A nested compound loudspeaker according to 13, wherein the function is periodic with period at least 4.

18. A nested compound loudspeaker according to claim 10, wherein the distance is an aperiodic function of the radial direction of the inner driver.

19. A nested compound loudspeaker according to claim 10, wherein the distance is a random function of the radial direction of the inner driver.

20. A nested compound loudspeaker according to claim 1, wherein the functional edge of the outer driver is polygonal in shape when viewed from the frontal side of the loudspeaker.

21. A nested compound loudspeaker according to claim 1, wherein the loudspeaker comprises a high frequency driver adapter configured to accommodate the inner driver wherein the clearance between the high frequency driver adapter and the functional edge of the outer driver is polygonal in shape when viewed from the frontal side of the loudspeaker.

22. A nested compound loudspeaker according to claim 20, wherein said polygon is a quadrangle.

23. A nested compound loudspeaker according to claim 20, herein said polygon is an octagon.

24. A nested compound loudspeaker according to claim 23, wherein every other angle of the octagon is approximately 180 degrees and every other angle is approximately 90 degrees.

25. A nested compound loudspeaker according to claim 24, wherein every other angle of the octagon is more than 180 degrees and every other angle is less than 90 degrees.

26. A nested compound loudspeaker according to claim 1, wherein the inner driver is mounted non-axially in relation to the voice coil axis of the outer driver.

27. A nested compound loudspeaker according to claim 26, wherein the offset is vertical.

28. A nested compound loudspeaker according to claim 1, wherein the difference between the shortest and longest distance is 5 to 20 percent of its average value.

29. A nested compound loudspeaker according to claim 28, wherein the difference between the shortest and longest distance is about 15 percent of its average value.

* * * * *